US007448360B2

(12) United States Patent
Kita

(10) Patent No.: US 7,448,360 B2
(45) Date of Patent: Nov. 11, 2008

(54) CONTROLLER OF INTERNAL COMBUSTION ENGINE

(75) Inventor: Masayuki Kita, Kariya (JP)

(73) Assignee: DENSO Corporation, Kariya (JP)

( * ) Notice: Subject to any disclaimer, the term of this patent is extended or adjusted under 35 U.S.C. 154(b) by 0 days.

(21) Appl. No.: 11/516,645

(22) Filed: Sep. 7, 2006

(65) Prior Publication Data

US 2007/0051342 A1 Mar. 8, 2007

(30) Foreign Application Priority Data

Sep. 7, 2005 (JP) ..... 2005-258695
Sep. 15, 2005 (JP) ..... 2005-267746

(51) Int. Cl.
*F02M 7/00* (2006.01)
*F02D 41/06* (2006.01)
*F02P 5/06* (2006.01)

(52) U.S. Cl. ..... 123/436; 123/491; 123/406.53; 123/406.24; 123/179.3; 701/113

(58) Field of Classification Search ..... 123/406.23, 123/406.24, 406.58, 406.59, 436, 406.54, 123/406.53, 491, 179.3, 179.5, 179.7; 701/103–105, 701/110, 113
See application file for complete search history.

(56) References Cited

U.S. PATENT DOCUMENTS 4,873,958 A * 10/1989 Abe ..... 123/406.54
4,889,095 A * 12/1989 Sogawa ..... 123/406.47
5,111,405 A * 5/1992 Maeda et al. ..... 701/110
5,241,480 A * 8/1993 Takaku et al. ..... 701/111
5,539,644 A * 7/1996 Ichikawa et al. ..... 701/111
5,747,681 A * 5/1998 Kuroda et al. ..... 73/117.3
5,832,404 A * 11/1998 Amano ..... 701/110
5,906,651 A * 5/1999 Amano ..... 701/110
5,909,724 A * 6/1999 Nishimura et al. ..... 123/436
6,023,964 A * 2/2000 Kanbara et al. ..... 73/117.3
6,334,094 B1 * 12/2001 Hirakata et al. ..... 702/145

FOREIGN PATENT DOCUMENTS

JP 8-284708 10/1996
JP 3490541 11/2003
JP 3498392 12/2003
JP 2007-77892 * 3/2007

* cited by examiner

*Primary Examiner*—Hai H Huynh
(74) *Attorney, Agent, or Firm*—Nixon & Vanderhye PC

(57) ABSTRACT

A rotation speed calculation interval is set near a combustion top dead center of each cylinder of an engine. An interval rotation time necessary for a crankshaft to rotate through the rotation speed calculation interval is calculated as angular speed information of the crankshaft in the rotation speed calculation interval for each combustion stroke of the engine. Engine rotation speed is calculated based on the interval rotation time. The angular speed information of the crankshaft in the rotation speed calculation interval set near the combustion top dead center reflects a combustion state or generated torque. By calculating the engine rotation speed based on the angular speed information, the engine rotation speed highly correlated with the combustion state or the generated torque of the engine can be calculated.

23 Claims, 7 Drawing Sheets

CONTROLLER OF INTERNAL COMBUSTION ENGINE

CROSS REFERENCE TO RELATED APPLICATION

This application is based on and incorporates herein by reference Japanese Patent Application No. 2005-258695 filed on Sep. 7, 2005 and Japanese Patent Application No. 2005-267746 filed on Sep. 15, 2005.

BACKGROUND OF THE INVENTION

1. Field of the Invention

The present invention relates to a controller of an internal combustion engine for calculating rotation speed of the engine and for improving startability of the engine.

2. Description of Related Art

A control system of an internal combustion engine calculates engine rotation speed in a predetermined cycle to comprehend an engine operation state. For example, a control system described in Japanese Patent No. 3490541 calculates a time difference between pulses outputted from a sensor every time a crankshaft of the engine rotates through a predetermined crank angle (CA) and calculates the engine rotation speed based on summation calculation value of a predetermined number of the time differences corresponding to one engine stroke (180° CA). Thus, the control system calculates the engine rotation speed averaging an influence of condensation and rarefaction of a generation frequency of the pulse signals (fluctuation of a pulse signal generation cycle) during one stroke.

In recent years, accurate control of a combustion state or generated torque of the engine has been required in order to improve fuel consumption, exhaust emission, drivability of the engine and the like. Therefore, it is necessary to accurately comprehend the actual combustion state or generated torque.

Generally, the generated torque changes in accordance with the combustion state of the engine, and the engine rotation speed changes. Therefore, the engine rotation speed is information to evaluate the combustion state or the generated torque. However, since the control system of Japanese Patent No. 3490541 calculates the engine rotation speed averaging the influence of the condensation and rarefaction of the generation frequency of the pulse signals during one stroke (engine rotation fluctuation due to the change in the combustion state or the generated torque), correlation between the engine rotation speed and the combustion state or the generated torque is reduced. If the engine rotation speed having the reduced correlation with the combustion state or the generated torque of the engine is used as the information of the combustion state or the generated torque when the combustion state or the generated torque is controlled, the combustion state or the generated torque cannot be controlled accurately.

During a start-up of the internal combustion engine or before completion of a warm-up of the engine after the start-up, there is a possibility that a paddled fuel amount (wet amount) to a wall surface of an air-intake port varies due to a variation in a property (volatility) of used fuel and an air-fuel ratio of a mixture gas (combustion air-fuel ratio) in a cylinder deviates from a target air-fuel ratio. This can deteriorate startability or exhaust emission. As a countermeasure, a control system described in JP-A-H08-284708 senses a rotation fluctuation for each combustion stroke immediately after the start-up of the engine and learns a combustion property based on summation data obtained by summing the rotation fluctuations by predetermined times. The control system corrects a fuel injection amount based on the learning value of the combustion property.

A control system described in Japanese patent No. 3498392 performs correction for increasing the fuel injection amount when the control system senses a start-up of the engine that is not optimum based on a time necessary for the rotation speed to exceed a predetermined rotation speed after the start-up, the initial maximum rotation speed immediately after the start-up, a rotation speed change rate since the rotation speed exceeds the predetermined rotation speed until the rotation speed reaches the maximum rotation speed immediately after the start-up, the minimum rotation speed after the maximum rotation speed and the like.

However, the control system of JP-A-H08-284708 cannot perform appropriate fuel correction corresponding to the fuel property before the learning of the fuel property sufficiently advances after the start-up of the engine. Accordingly, there is a possibility that a deviation in the air-fuel ratio is generated due to the fuel property and the rotation speed fluctuation is caused.

The control system described in Japanese Patent No. 3498392 performs the correction for increasing the fuel injection amount after the start-up of the engine that is not optimum is sensed. Therefore, there is a possibility that the rotation speed fluctuation is caused before the start-up that is not optimum is sensed.

Moreover, as shown in FIG. 6, if the air-fuel ratio $\lambda$ deviates from the target air-fuel ratio $\lambda t$ toward a lean side during the start-up of the engine due to a fuel property of the used fuel, a temporal change of the engine or the like, the generated torque correspondingly decreases from the torque Tt that should be obtained at the target air-fuel ratio $\lambda t$. In FIG. 6, C represents a range in which the combustion torque does not increase even if the fuel is increased, D is a range in which the combustion torque increases if the fuel amount is increased, Qc is a fuel increase necessary for correcting the torque, and Tf is a decrease of the torque, for example, due to heavy fuel. The above-described control systems do not consider the torque fluctuation during the start-up. Therefore, even if the generated torque is deviated from the appropriate torque corresponding to the target air-fuel ratio, the deviation of the torque cannot be corrected. As a result, the engine cannot be started smoothly with an appropriate rotation speed behavior.

SUMMARY OF THE INVENTION

It is an object of the present invention to provide a controller of an internal combustion engine capable of calculating rotation speed of the engine highly correlated with a combustion state or generated torque of the engine.

It is another object of the present invention to provide a controller of an internal combustion engine capable of accurately controlling generated torque to appropriate torque corresponding to a target air-fuel ratio in an early stage of a start-up of the engine and of smoothly starting the engine with an appropriate rotation speed behavior.

According to an aspect of the present invention, an interval setting device sets a rotation speed calculation interval across a top dead center of a combustion stroke of an internal combustion engine, and a rotation speed calculation device calculates rotation speed of the engine based on angular speed of a crankshaft of the engine or information correlated with the angular speed in the rotation speed calculation interval.

The internal combustion engine causes combustion of a mixture gas near a top dead center of a combustion stroke. Torque is generated by combustion pressure, and angular acceleration (AA) (change rate of angular speed) of a crankshaft changes in accordance with the generated torque as shown in FIG. 2. Accordingly, the angular speed information (angular speed or information correlated with the angular speed) of the crankshaft in the rotation speed calculation interval set across the top dead center of the combustion stroke accurately reflects a combustion state or the generated torque. Therefore, by calculating the rotation speed of the engine based on the angular speed information, the rotation speed of the engine highly correlated with the combustion state or the generated torque of the engine can be calculated.

According to another aspect of the present invention, an increase calculation device calculates a rotation speed increase or rotation speed increase information correlated with the rotation speed increase for each combustion of the engine in a period in which the rotation speed increases immediately after a beginning of a start-up of the engine, and a fluctuation calculation device calculates a torque fluctuation of the engine by comparing the rotation speed increase information calculated by the increase calculation device with target rotation speed increase information corresponding to a target air-fuel ratio.

If the generated torque becomes greater than or less than appropriate torque corresponding to the target air-fuel ratio during the rotation speed increasing period immediately after the beginning of the start-up of the engine, the rotation speed increase correspondingly becomes greater than or less than the target rotation speed increase corresponding to the target air-fuel ratio. The target rotation speed increase is a rotation speed increase in the case where the start-up is performed while conforming the combustion air-fuel ratio to the target air-fuel ratio from the beginning of the start-up. Accordingly, by comparing the rotation speed increase information and the target rotation speed increase information, the fluctuation of the actual torque with respect to the appropriate torque corresponding to the target air-fuel ratio can be calculated accurately.

Thus, correction control for conforming the generated torque to the appropriate torque corresponding to the target air-fuel ratio based on the torque fluctuation can be started from the time when the torque fluctuation is calculated during the rotation speed increasing period immediately after the beginning of the start-up of the engine. The generated torque can be accurately controlled to the appropriate torque in the early stage of the start-up. As a result, the engine can be smoothly started with an appropriate rotation speed behavior, improving the startability of the engine.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF EXAMPLE EMBODIMENTS

Figure 1:
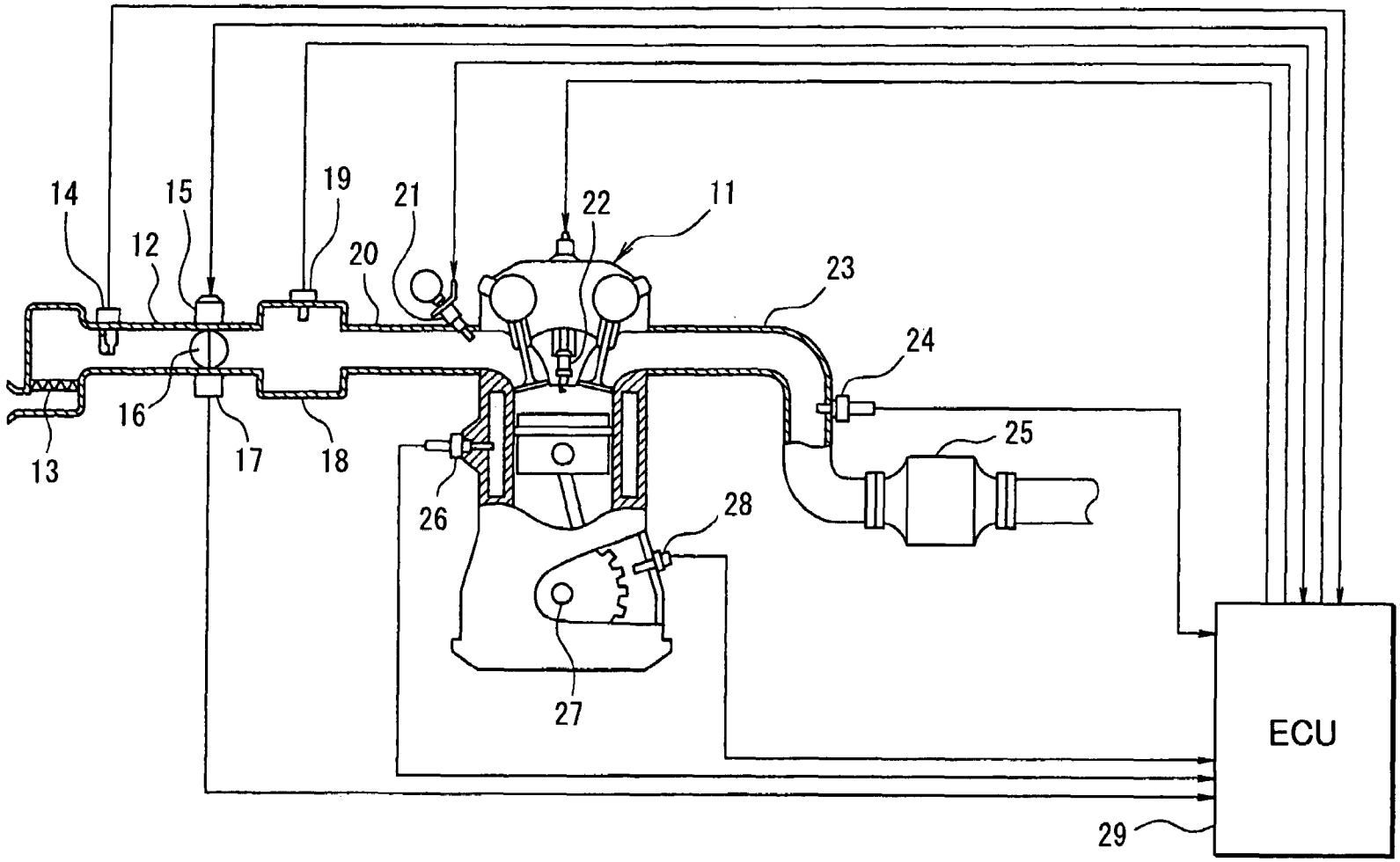
FIG. 1 is a schematic diagram showing an engine control system according to a first example embodiment of the present invention.

Referring to FIG. 1, an engine control system according to a first example embodiment of the present invention is illustrated. An air cleaner 13 is provided at the upstream-most portion of an intake pipe 12 of an internal combustion engine 11. An airflow meter 14 for sensing an air intake amount is provided downstream of the air cleaner 13. A throttle valve 16, an opening degree (throttle opening degree) of which is regulated by a motor 15, and a throttle opening degree sensor 17 for sensing the opening degree of the throttle valve 16 are provided downstream of the airflow meter 14.

A surge tank 18 is provided downstream of the throttle valve 16. An intake pipe pressure sensor 19 for sensing intake pipe pressure is provided in the surge tank 18. The surge tank 18 is provided with an intake manifold 20 for introducing the air into respective cylinders of the engine 11. Fuel injection valves 21 for injecting the fuel are attached near intake ports of the intake manifold 20 corresponding to the respective cylinders. Ignition plugs 22 are mounted to a cylinder head of the engine 11 for the respective cylinders. A mixture gas in the cylinder is ignited by a spark discharge of each ignition plug 22.

An exhaust gas sensor 24 (air-fuel ratio sensor, oxygen sensor or the like) for sensing an air-fuel ratio, rich/lean of exhaust gas or the like is provided in an exhaust pipe 23 of the engine 11. A catalyst 25 such as a three-way catalyst for purifying the exhaust gas is provided downstream of the exhaust gas sensor 24.

A coolant temperature sensor 26 for sensing coolant temperature and a crank angle sensor 28 for outputting a crank angle signal (pulse signal) every time a crankshaft 27 of the engine 11 rotates through a predetermine crank angle (for example, 6° CA) are attached to the cylinder block of the engine 11. The unit [° CA] represents a crank angle having the same dimension as the general unit [°] representing the degree of the angle. The crank angle and the engine rotation speed are sensed based on the crank angle signal of the crank angle sensor 28.

The outputs of the various sensors are inputted into an engine control unit (ECU) 29. The ECU 29 is structured mainly by a microcomputer. The ECU 29 executes various types of engine control programs stored in ROM (storage medium) incorporated in the ECU 29. Thus, the ECU 29 controls a fuel injection amount of the fuel injection valve 21 and ignition timing of the ignition plug 22 in accordance with the engine operation state.

Figure 4:
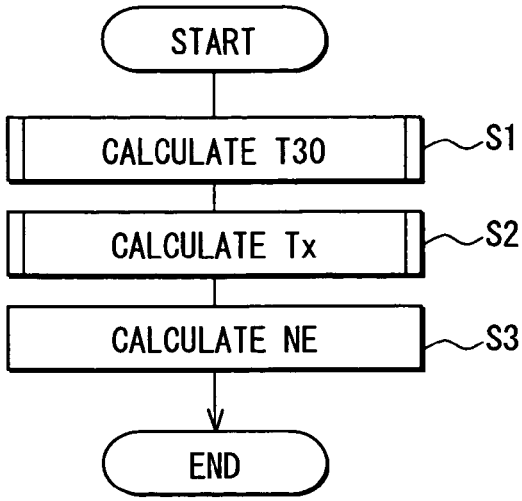
FIG. 4 is a flowchart showing processing steps of an engine rotation speed calculation program according to the FIG. 1 embodiment.

At that time, the ECU 29 executes a rotation speed calculation program shown in FIG. 4. Thus, the ECU 29 calculates angular speed information of the crankshaft 27 during a predetermined rotation speed calculation interval set near a combustion TDC (top dead center of combustion stroke) of each cylinder of the engine 11. The predetermined rotation speed calculation interval is a rotation speed calculation interval set across the combustion TDC or a rotation speed calculation interval set immediately after the combustion TDC. The angular speed information of the crankshaft 27 is a time necessary for the crankshaft 27 to rotate through the rotation speed calculation interval, for example. The ECU 29 calculates the engine rotation speed based on the angular speed information.

Figure 2:
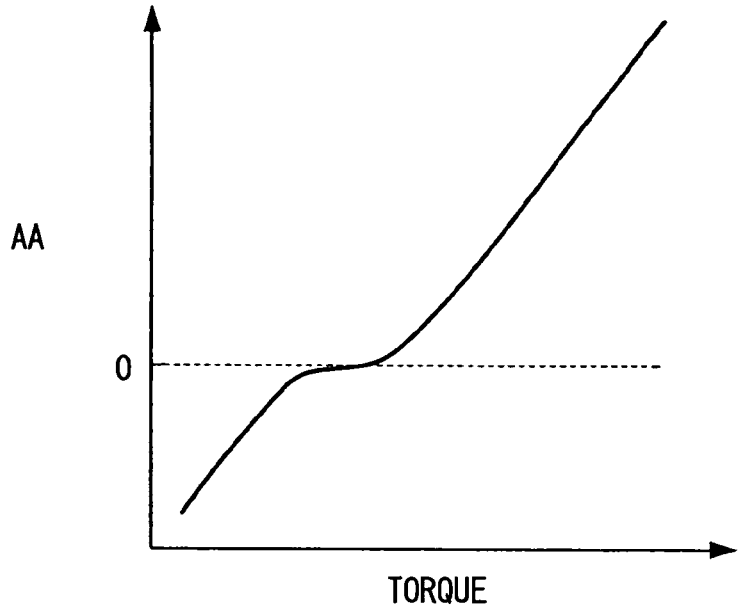
FIG. 2 is a graph showing a relationship between generated torque and angular acceleration.
Figure 3:
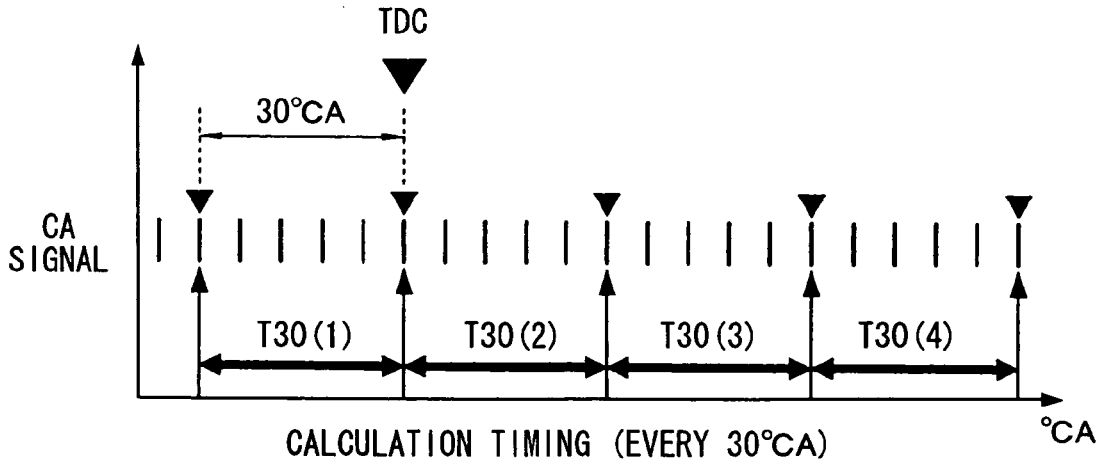
FIG. 3 is a diagram showing calculation timing of time necessary for rotation through 30° CA according to the FIG. 1 embodiment.

The engine 11 causes combustion of a mixture gas near the combustion TDC (TDC in FIG. 3). Torque is generated in accordance with a combustion state. Angular acceleration (M: change rate of angular speed) of the crankshaft 27 changes in accordance with the generated torque as shown in FIG. 2. Therefore, the angular speed information of the crankshaft 27 in the rotation speed calculation interval set near the combustion TDC reflects the combustion state or the generated torque at high accuracy. By calculating the engine rotation speed NE based on the angular speed information, the engine rotation speed NE highly correlated with the combustion state or the generated torque of the engine 11 can be calculated.

For example, every time the crankshaft 27 rotates through 30° CA, a time T30 necessary for the crankshaft 27 to rotate through 30° CA is calculated based on the crank angle signal (CA signal) of the crank angle sensor 28 as shown in FIG. 3. As shown in FIG. 3, the time T30 of the crank angle range from 30° CA before the combustion TDC to the combustion TDC is referred to as T30(1), and the time T30 of the crank angle range from the combustion TDC to 30° CA after the combustion TDC is referred to as T30(2). The time T30 of the crank angle range from 30° CA after the combustion TDC to 60° CA after the combustion TDC is referred to as T30(3), and the time T30 of the crank angle range from 60° CA after the combustion TDC to 90° CA after the combustion TDC is referred to as T30(4).

Then, with a method corresponding to the number of the cylinders of the engine 11, an interval rotation time Tx [s] necessary for the crankshaft 27 to rotate through the rotation speed calculation interval is calculated as the angular speed information of the crankshaft 27 of the rotation speed calculation interval set near the combustion TDC by using the times T30(1) to T30(4) near the combustion TDC. The interval rotation time Tx is converted into the engine rotation speed NE [rpm].

In the case of an eight-cylinder engine (combustion interval is 90° CA), the rotation speed calculation interval is set at the crank angle range from the combustion TDC to 30° CA after the combustion TDC to set the rotation speed calculation interval shorter than the combustion interval. In this case, the time T30(2) from the combustion TDC to 30° CA after the combustion TDC is used as the interval rotation time Tx[s] necessary for the crankshaft 27 to rotate through the rotation speed calculation interval (Tx=T30(2)). The engine rotation speed NE [rpm] is calculated by using the interval rotation time Tx[s] as follows: NE=60/(Tx×360/30).

Alternatively, the rotation speed calculation interval may be set at the crank angle range of 30° CA from 30° CA after the combustion TDC to 60° CA after the combustion TDC. In this case, the time T30(3) from 30° CA after the combustion TDC to 60° CA after the combustion TDC is used as the interval rotation time Tx[s] necessary for the crankshaft 27 to rotate through the rotation speed calculation interval (Tx =T30(3)). The engine rotation speed NE[rpm] is calculated by using the interval rotation time Tx[s] as follows: NE=60/(Tx×360/30).

In the case of a four-cylinder engine (combustion interval is 180° CA) or in the case of a six-cylinder engine (combustion interval is 120° CA), the rotation speed calculation interval is set at the crank angle range of 60° CA from the combustion TDC to 60° CA after the combustion TDC to set the rotation speed calculation interval shorter than the combustion interval. In these cases, the time T30(2) from the combustion TDC to 30° CA after the combustion TDC and the time T30(3) from 30° CA after the combustion TDC to 60° CA after the combustion TDC are added to calculate the interval rotation time Tx[s] necessary for the crankshaft 27 to rotate through the rotation speed calculation interval (Tx=T30(2)+T30(3)). The engine rotation speed NE[rpm] is calculated by using the interval rotation time Tx[s] as follows: NE=60/(Tx×360/60).

Alternatively, the rotation speed calculation interval may be set at the crank angle range of 60° CA from 30° CA before the combustion TDC to 30° CA after the combustion TDC. In this case, the time T30(1) from 30° CA before the combustion TDC to the combustion TDC and the time T30(2) from the combustion TDC to 30° CA after the combustion TDC are added to calculate the interval rotation time Tx [s] necessary for the crankshaft 27 to rotate through the rotation speed calculation interval (Tx=T30(1)+T30(2)). The engine rotation speed NE[rpm] is calculated by using the interval rotation time Tx[s] as follows: NE=60/(Tx×360/60).

In the case of the four-cylinder engine or the six-cylinder engine, the rotation speed calculation interval may be set at the crank angle range of 90° CA from the combustion TDC to 90° CA after the combustion TDC to set the rotation speed calculation interval shorter than the combustion interval. In this case, the time T30(2) from the combustion TDC to 30° CA after the combustion TDC, the time T30(3) from 30° CA after the combustion TDC to 60° CA after the combustion TDC and the time T30(4) from 60° CA after the combustion TDC to 90° CA after the combustion TDC are added to calculate the interval rotation time Tx[s] necessary for the crankshaft 27 to rotate through the rotation speed calculation interval (Tx=T30(2)+T30(3)+T30(4)). The engine rotation speed NE[rpm] is calculated by using the interval rotation time Tx[s] as follows: NE=60/(Tx×360/90).

Alternatively, the rotation speed calculation interval may be set at the crank angle range of 90° CA from 30° CA before the combustion TDC to 60° CA after the combustion TDC. In this case, the time T30(1) from 30° CA before the combustion TDC to the combustion TDC, the time T30(2) from the combustion TDC to 30° CA after the combustion TDC and the time T30(3) from 30° CA after the combustion TDC to 60° CA after the combustion TDC are added to calculate the interval rotation time Tx[s] necessary for the crankshaft 27 to rotate through the rotation speed calculation interval (Tx=T30(1)+T30(2)+T30(3)). The engine rotation speed NE[rpm] is calculated by using the interval rotation time Tx[s] as follows: NE=60/(Tx×360/90).

The rotation speed calculation interval may be modified. For example, in the case of the eight-cylinder engine, the rotation speed calculation interval may be set at the crank angle range of 30° CA from 10° CA before the combustion TDC to 20° CA after the combustion TDC. In the case of the four-cylinder engine or the six-cylinder engine, the rotation speed calculation interval may be set at the crank angle range of 60° CA from 10° CA before the combustion TDC to 50° CA after the combustion TDC or the crank angle range of 90° CA from 10° CA before the combustion TDC to 80° CA after the combustion TDC.

The above-described calculation of the engine rotation speed NE is executed by the ECU 29 based on the engine rotation speed calculation program shown in FIG. 4. The rotation speed calculation program shown in FIG. 4 is executed in a predetermined cycle while power supply to the ECU 29 is ON.

If the program of FIG. 4 is started, first, Step S1 calculates the time T30 necessary for the crankshaft 27 to rotate through 30° CA based on the crank angle signal of the crank angle sensor 28 every time the crankshaft 27 rotates through 30° CA. Then, Step S2 calculates the interval rotation time Tx[s] necessary for the crankshaft 27 to rotate through the rotation speed calculation interval by using the times T30(1) to T30(4) near the combustion TDC as the angular speed information of the crankshaft 27 in the rotation speed calculation interval set near the combustion TDC for each combustion stroke of the engine 11. Then, Step S3 converts the interval rotation time Tx[s] necessary for the crankshaft 27 to rotate through the rotation speed calculation interval into the engine rotation speed NE[rpm] for each combustion stroke of the engine 11.

Figure 5:
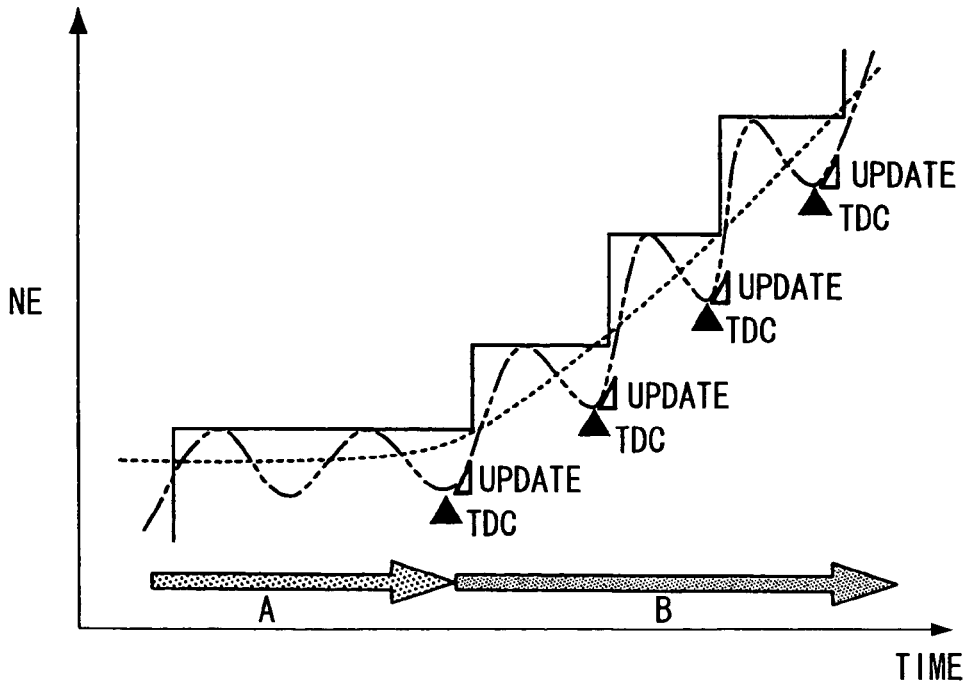
FIG. 5 is a time chart showing implementation example of the engine rotation speed calculation according to the FIG. 1 embodiment.

In FIG. 5, A represents an interval in which the engine is cranked (started) and B represents an interval in which the rotation speed NE increases due to a start of combustion. A chain double-dashed line represents actual engine rotation speed NE, a broken line represents engine rotation speed NE calculated by a conventional calculation method, and a solid line represents the engine rotation speed NE calculated by a calculation method according to the present embodiment. As shown by the broken line in FIG. 5, the conventional calculation method of the engine rotation speed NE calculates the engine rotation speed NE averaging the influence of the engine rotation fluctuation due to the change in the combustion state or the generated torque of the engine 11. Accordingly, the correlation between the engine rotation speed NE and the combustion state or the generated torque of the engine 11 is reduced.

In contrast, in the present embodiment, as shown by the solid line in FIG. 5, the angular speed information of the crankshaft 27 in the rotation speed calculation interval set near the combustion TDC (TDC in FIG. 5) of each cylinder of the engine 11 is calculated. The rotation speed calculation interval is the rotation speed calculation interval set across the combustion TDC or the rotation speed calculation interval set immediately after the combustion TDC. The angular speed information is the time necessary for the crankshaft 27 to rotate through the rotation speed calculation interval, for example. The engine rotation speed NE is calculated based on the angular speed information and updated at timing "UPDATE" shown in FIG. 5. Accordingly, the engine rotation speed NE highly correlated with the combustion state or the generated torque of the engine 11 is calculated. Thus, when the combustion state or the generated torque of the engine 11 is controlled, the engine rotation speed highly correlated with the combustion state or the generated torque can be used as the information of the combustion state or the generated torque. As a result, the generated torque of the engine 11 can be controlled at high accuracy even under a condition such as a start-up or transitional operation of the engine in which the generated torque changes rapidly.

In the case of the eight-cylinder engine (combustion interval is 90° CA), the rotation speed calculation interval is set at the crank angle range of 30° CA immediately after the combustion TDC or the crank angle range of 30° CA across the combustion TDC. Accordingly, even in the case of the eight-cylinder engine having a relatively short combustion interval, the rotation speed calculation interval is set shorter than the combustion interval such that the engine rotation speed highly correlated with the combustion state or the generated torque in the present combustion stroke is calculated without being affected by the previous or following combustion stroke.

In the present embodiment, in the case of the four-cylinder engine (combustion interval is 180° CA) or the six-cylinder engine (combustion interval is 120° CA), the rotation speed calculation interval is set at the crank angle range of 60° CA or 90° CA immediately after the combustion TDC or the crank angle range of 60° CA or 90° CA across the combustion TDC. Thus, the rotation speed calculation interval is set shorter than the combustion interval. As a result, the calculation accuracy of the engine rotation speed can be improved by suitably lengthening the rotation speed calculation interval while calculating the engine rotation speed highly correlated with the combustion state or the generated torque of the present combustion stroke without being affected by the previous or following combustion stroke.

In the case of the four-cylinder engine or the six-cylinder engine, the rotation speed calculation interval may be set at the crank angle range of 30° CA immediately after the combustion TDC or the crank angle range of 30° CA across the combustion TDC. In the case of the eight-cylinder engine, the rotation speed calculation interval may be set at the crank angle range of 60° CA immediately after the combustion TDC or the crank angle of 60° CA across the combustion TDC. Thus, the rotation speed calculation interval is not limited to the crank angle range described in the present embodiment, but may be modified arbitrarily.

In the present embodiment, the rotation speed calculation interval is set at the crank angle range based on the combustion TDC. Alternatively, the rotation speed calculation interval may be set at a crank angle range immediately after ignition timing based on the ignition timing (for example, crank angle range from the ignition timing to 30° CA after the ignition timing or a crank angle range from 30° CA after the ignition timing to 60° CA after the ignition timing). Thus, the rotation speed calculation interval can be changed in accordance with the change of the combustion period corresponding to the ignition timing. As a result, the engine rotation speed highly correlated with the combustion state or the generated torque can be calculated without being affected by the ignition timing.

In the present embodiment, the time necessary for the crankshaft 27 to rotate through the rotation speed calculation interval is used as the angular speed information of the crankshaft 27 in the rotation speed calculation interval to calculate the engine rotation speed NE. Alternatively, the engine rotation speed NE may be calculated by using the angular speed or the angular acceleration of the crankshaft 27 in the rotation speed calculation interval.

Application of the present invention is not limited to the four-cylinder engine, the six-cylinder engine and the eight-cylinder engine. The present invention may be applied to any engine having another number of cylinders (three-cylinder engine, five-cylinder engine, ten-cylinder engine, twelve-cylinder engine, and the like).

Next, a control system of the engine 11 according to a second example embodiment of the present invention will be described in reference to drawings.

Figure 6:
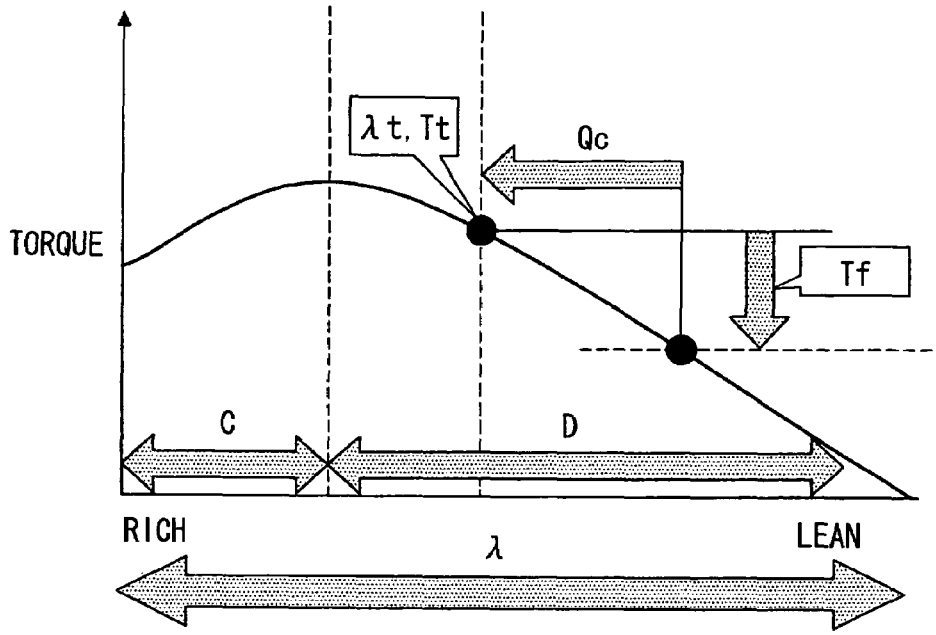
FIG. 6 is a graph showing a relationship between a combustion air-fuel ratio and generated torque.

Generally, if an air-fuel ratio λ deviates from a target air-fuel ratio λt toward a lean side due to a fuel property of the used fuel or a temporal change of the engine 11 during the start-up of the engine 11, the generated torque correspondingly becomes less than the appropriate torque Tt corresponding to the target air-fuel ratio λt as shown in FIG. 6. The appropriate torque Tt is the torque generated in the case where the start-up is performed while conforming the combustion air-fuel ratio λ to the target air-fuel ratio λt from the beginning of the start-up. In this case, as shown by a broken line in FIG. 7, the engine rotation speed NE cannot be increased sufficiently during the start-up of the engine 11. As a result, there is a possibility that the engine 11 cannot be started with an appropriate behavior of the rotation speed NE. A chain double dashed line in FIG. 7 represents the engine rotation speed NE in the case where the start-up is performed while conforming the combustion air-fuel ratio λ to the target air-fuel ratio λt from the beginning of the start-up.

Figure 8:
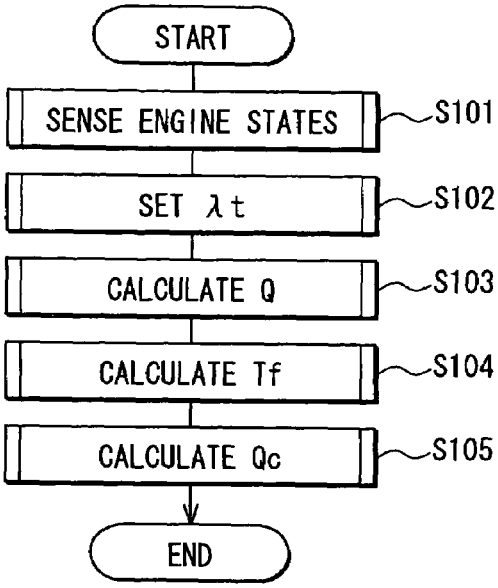
FIG. 8 is a flowchart showing processing steps of a start-up torque correction control program according to the FIG. 7 embodiment.
Figure 9:
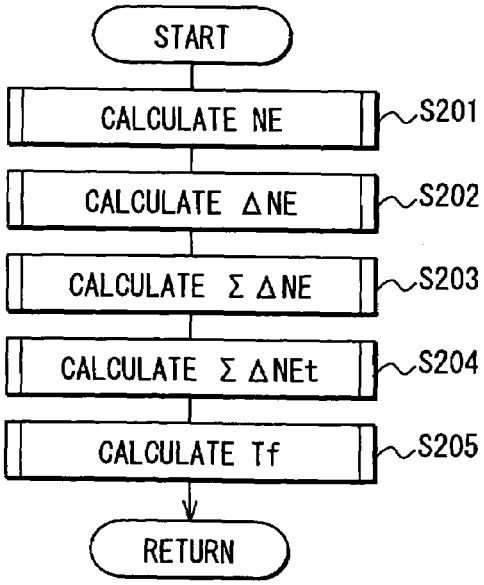
FIG. 9 is a flowchart showing processing steps of a torque fluctuation calculation program according to the FIG. 7 embodiment.
Figure 10:
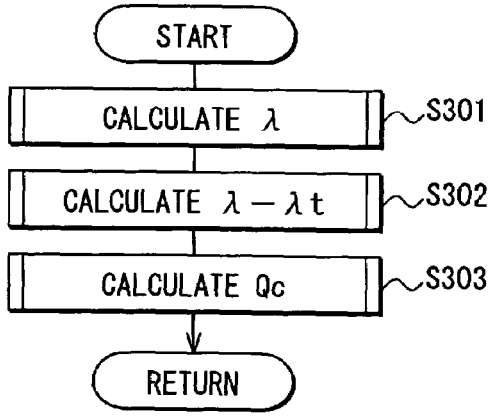
FIG. 10 is a flowchart showing processing steps of a fuel injection correction value calculation program according to the FIG. 7 embodiment.

Therefore, the ECU 29 of the present embodiment executes the programs for the torque correction control during the start-up as shown in FIGS. 8 to 10. The ECU 29 calculates an engine rotation speed increase ΔNE for each combustion of the engine 11 during a rotation speed increasing period immediately after the beginning of the start-up of the engine 11 and integrates the engine rotation speed increase ΔNE. The ECU 29 calculates a torque fluctuation Tf of the engine 11 based on a deviation between the engine rotation speed increase integration value ΣΔNE and a target engine rotation speed increase integration value ΣΔNEt corresponding to the target air-fuel ratio λt. The target engine rotation speed increase integration value ΣΔNEt is an integration value of the engine rotation speed increase ΔNE in the case where the start-up is performed while conforming the combustion air-fuel ratio λ to the target air-fuel ratio λt from the beginning of the start-up. The torque fluctuation Tf of the engine 11 represents excess or deficiency of the generated torque with respect to the appropriate torque. The ECU 29 calculates a fuel injection correction value Qc for conforming the generated torque to the appropriate torque corresponding to the target air-fuel ratio λt based on the torque fluctuation Tf.

If the generated torque becomes greater than or less than the appropriate torque corresponding to the target air-fuel ratio λt during the rotation speed increasing period immediately after the beginning of the start-up of the engine 11, the engine rotation speed increase ΔNE correspondingly becomes greater than or less than the target engine rotation speed increase ΔNEt corresponding to the target air-fuel ratio Δt. The target engine rotation speed increase ΔNEt is an engine rotation speed increase in the case where the start-up is performed while conforming the combustion air-fuel ratio λ to the target air-fuel ratio λt from the beginning of the start-up. By comparing the engine rotation speed increase integration value ΣΔNE and the target engine rotation speed increase integration value ΣΔNEt, the torque fluctuation Tf (excess or deficiency of the generated torque with respect to the appropriate torque) can be calculated accurately.

Figure 7:
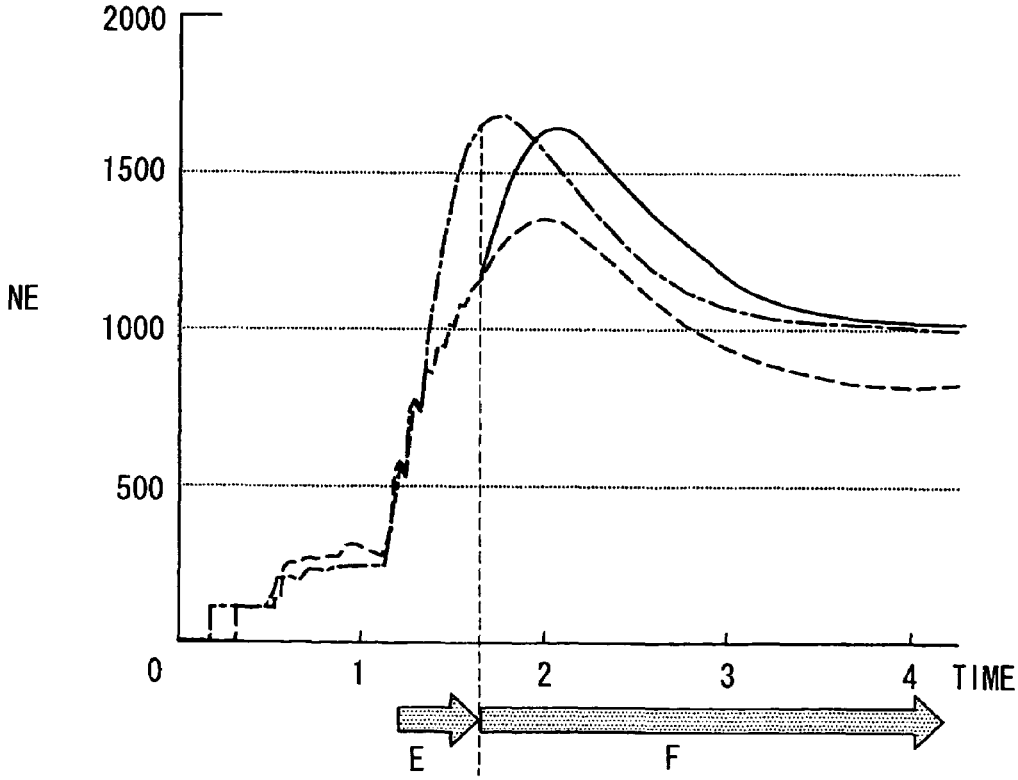
FIG. 7 is a time chart showing start-up torque correction control according to a second example embodiment of the present invention.

Thus, as shown by a solid line in FIG. 7, the torque correction control based on the torque fluctuation Tf can be started from the time when the torque fluctuation Tf is calculated during the rotation speed increasing period immediately after the beginning of the start-up of the engine 11 to conform the generated torque to the appropriate torque. Thus, the generated torque can be accurately controlled to the appropriate torque in the early stage of the start-up. As a result, the engine 11 can be smoothly started with an appropriate rotation speed behavior. In FIG. 7, E represents an interval in which the torque shortage is sensed, and F is an interval in which the combustion at the appropriate torque is enabled.

Next, processing contents of the programs for start-up torque correction control will be described in reference to FIGS. 8 to 10.

The start-up torque correction control program shown in FIG. 8 is executed in a predetermined cycle during the start-up of the engine 11. If the routine of FIG. 8 is started, first, Step S101 reads in the engine states such as the coolant temperature sensed by the coolant temperature sensor 26. Then, Step S102 calculates the target air-fuel ratio λt based on the engine states (coolant temperature and the like). Then, Step S103 calculates a basic fuel injection amount Q based on the target air-fuel ratio λt and the like.

Then, Step S104 executes a torque fluctuation calculation program shown in FIG. 9. The rotation speed increase ΔNE is calculated for each combustion of the engine 11 in the rotation speed increasing period immediately after the beginning of the start-up of the engine 11 and the rotation speed increase ΔNE is integrated. The torque fluctuation Tf (excess or deficiency of the generated torque with respect to the appropriate torque) is calculated based on a deviation between the rotation speed increase integration value ΣΔNEt and a target rotation speed increase integration value ΣΔNEt corresponding to the target air-fuel ratio λt.

Then, Step S105 executes a fuel injection correction value calculation program shown in FIG. 10. Thus, the fuel injection correction value Qc for conforming the generated torque to the appropriate torque corresponding to the target air-fuel ratio λt is calculated based on the torque fluctuation Tf.

The torque fluctuation calculation program shown in FIG. 9 is a subroutine executed at Step S104 of the start-up torque correction control program shown in FIG. 8. If the torque fluctuation calculation program of FIG. 9 is executed, Step S201 executes an engine rotation speed calculation program (not shown). Thus, the angular speed information of the crankshaft 27 in a predetermined rotation speed calculation interval set near the combustion TDC (top dead center of combustion stroke) of each cylinder is calculated for each combustion of the engine 11 in the rotation speed increasing period immediately after the beginning of the start-up of the engine 11. The rotation speed calculation interval is a rotation speed calculation interval set across the combustion TDC or a rotation speed calculation interval set immediately after the combustion TDC. The angular speed information of the crankshaft 27 is a time necessary for the crankshaft 27 to rotate through the rotation speed calculation interval, for example. The engine rotation speed NE is calculated based on the angular speed information. Thus, the engine rotation speed NE highly correlated with the combustion state or the generated torque of the engine 11 is calculated.

Then, Step S202 calculates the engine rotation speed increase ΔNE by subtracting a previous value of the engine rotation speed NE from a present value of the engine rotation speed NE for each combustion of the engine 11 in the rotation speed increasing period immediately after the beginning of the start-up of the engine 11. Then, Step S203 calculates the engine rotation speed increase integration value ΣΔNEt by integrating the engine rotation speed increase ΔNE of a predetermined period (for example, eight combustions) from the start of the combustion in the engine 11.

Then, Step S204 searches a map of the target engine rotation speed increase integration value ΣΔNEt to calculate the target engine rotation speed increase integration value ΣΔNEt corresponding to the target air-fuel ratio λt. The target engine rotation speed increase integration value ΣΔNEt is an integration value of the engine rotation speed increase ΔNE in the case where the start-up is performed while conforming the combustion air-fuel ratio λ to the target air-fuel ratio λt from the beginning of the start-up. The map of the target engine rotation speed increase integration value ΣΔNEt is set for each area of the engine states (at least one of the start-up coolant temperature, number of combustions, the coolant temperature, intake pipe pressure, intake valve timing, an engine load, intake air temperature and the like) based on experiment data, design data and the like and is stored in the ROM of the ECU 29 in advance.

Alternatively, a basic target engine rotation speed increase integration value corresponding to the target air-fuel ratio λt may be calculated, and then, the final target engine rotation speed increase integration value ΣΔNEt may be calculated by correcting the basic target engine rotation speed increase integration value in accordance with the engine states (at least one of the start-up coolant temperature, the number of the combustions, the coolant temperature, the intake pipe pressure, the intake valve timing, the engine load, the intake air temperature and the like).

Figure 11:
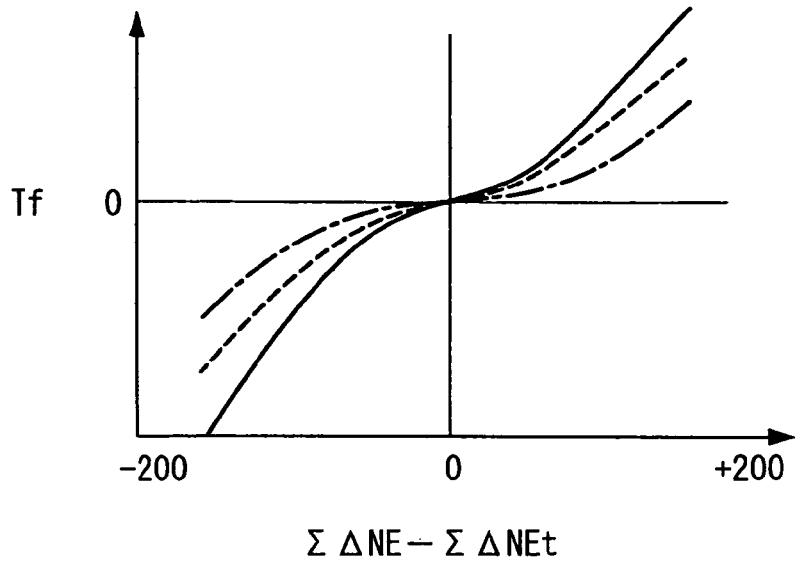
FIG. 11 is a graph showing an example of a torque fluctuation map according to the FIG. 7 embodiment.

Then, Step S205 searches a map of the torque fluctuation Tf shown in FIG. 11 to calculate the torque fluctuation Tf (excess or deficiency of the generated torque with respect to the appropriate torque) corresponding to a deviation between the engine rotation speed increase integration value ΣΔNEt and the target engine rotation speed increase integration value Σ NEt. The map of the torque fluctuation Tf shown in FIG. 11 is set for each area of the engine states (at least one of the start-up coolant temperature, the number of the combustions, the coolant temperature, the intake pipe pressure, the intake valve timing, the engine load, the intake air temperature and the like) based on the experiment data, the design date and the like and is stored in the ROM of the ECU 29 in advance.

Alternatively, a basic torque fluctuation corresponding to the deviation between the engine rotation speed increase integration value ΣΔNEt and the target engine rotation speed increase integration value ΣΔNEt may be calculated, and then, the final torque fluctuation Tf may be calculated by correcting the basic torque fluctuation in accordance with the engine states (at least one of the start-up coolant temperature, the number of the combustions, the coolant temperature, the intake pipe pressure, the intake valve timing, the engine load, the intake air temperature and the like).

Figure 12:
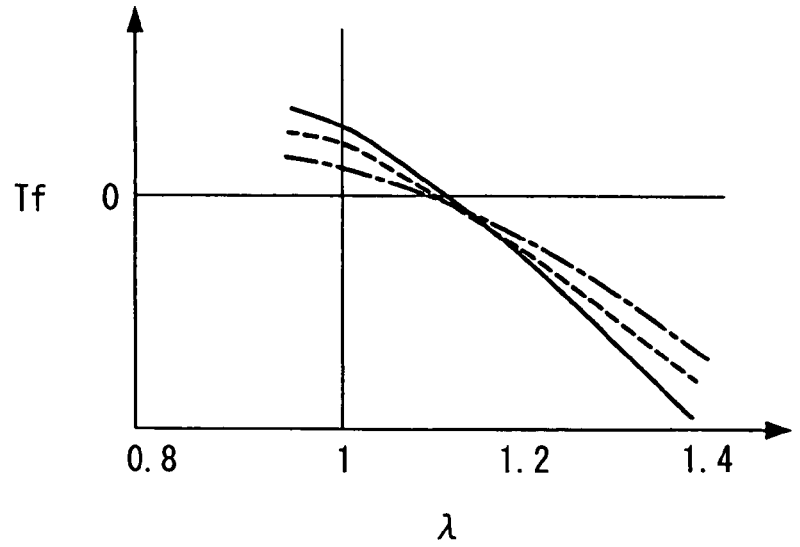
FIG. 12 is a graph showing an example of a combustion air-fuel ratio map according to the FIG. 7 embodiment.

The fuel injection correction value calculation program shown in FIG. 10 is a subroutine executed at Step S105 of the start-up torque correction control program shown in FIG. 8. If the program of FIG. 10 is started, first, Step S301 searches a map of the combustion air-fuel ratio λ shown in FIG. 12 to calculate the combustion air-fuel ratio λ (actual air-fuel ratio of an air-fuel mixture in the cylinder) corresponding to the torque fluctuation Tf. The map of the combustion air-fuel ratio λ shown in FIG. 12 is set for each area of the engine states (at least one of the start-up coolant temperature, the number of the combustions, the coolant temperature, the intake air temperature, a previous combustion air-fuel ratio λ, a deviation between the previous combustion air-fuel ratio λ and the target air-fuel ratio λt and the like) based on the experiment data, the design date and the like and is stored in the ROM of the ECU 29 in advance.

Alternatively, a basic combustion air-fuel ratio corresponding to the torque fluctuation Tf may be calculated, and then, the basic combustion air-fuel ratio may be corrected in accordance with the engine states (at least one of the start-up coolant temperature, the number of the combustions, the coolant temperature, the intake air temperature, the previously calculated air-fuel ratio λ, the deviation between the previously calculated air-fuel ratio λ and the target air-fuel ratio λt and the like) to calculate the final combustion air-fuel ratio λ.

Then, Step S302 calculates a deviation between the target air-fuel ratio λt and the combustion air-fuel ratio λ. Then, Step S303 calculates the fuel injection correction value Qc for conforming the combustion air-fuel ratio λ to the target air-fuel ratio λt based on the deviation between the target air-fuel ratio λt and the combustion air-fuel ratio λ. Thus, the fuel injection amount is corrected to conform the generated torque to the appropriate torque.

In the present embodiment, the engine rotation speed increase ΔNE is calculated for each combustion of the engine 11 in the rotation speed increasing period immediately after the beginning of the start-up of the engine 11 and the engine rotation speed increase is integrated. The torque fluctuation Tf of the engine 11 (excess or deficiency of the generated torque with respect to the appropriate torque) is calculated based on the deviation between the engine rotation speed increase integration value ΣΔNEt and the target engine rotation speed increase integration value ΣΔNEt . Then, the fuel injection correction value Qc is calculated to conform the generated torque to the appropriate torque corresponding to the target air-fuel ratio λt based on the torque fluctuation Tf.

Figure 13:
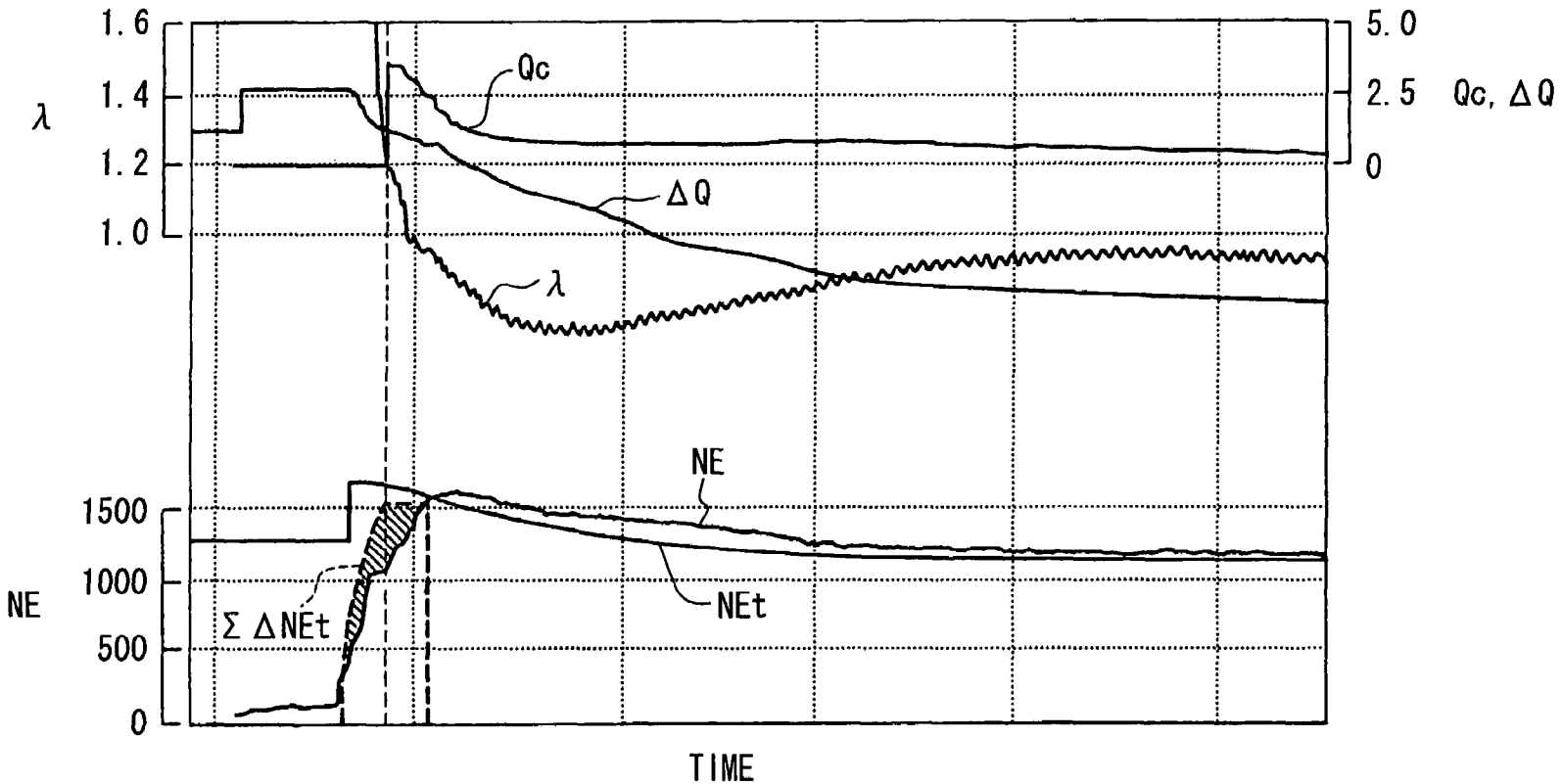
FIG. 13 is a time chart showing an implementation example of the start-up torque correction control according to the FIG. 7 embodiment.

Thus, as shown in FIG. 13, even if the combustion air-fuel ratio λ in the beginning of the start-up deviates from the target air-fuel ratio λt due to the fuel property of the used fuel or the temporal change of the engine 11, the torque correction control can be started since the torque fluctuation Tf is calculated in the rotation speed increasing period immediately after the beginning of the start-up of the engine 11 to conform the generated torque to the appropriate torque based on the torque fluctuation. Thus, the generated torque can be accurately controlled to the appropriate torque in the early stage of the start-up. As a result, the engine 11 can be started smoothly with the appropriate rotation speed behavior, improving the startability. FIG. 13 shows an example in which the engine 11 is started with heavy fuel at the coolant temperature of 10° C. A solid line ΔQ in FIG. 13 represents an increase of the fuel injection amount after the start-up and NEt is target rotation speed.

Moreover, in the present embodiment, the torque fluctuation is calculated based on the deviation between the engine rotation speed increase integration value and the target engine rotation speed increase integration value. Accordingly, even if the engine rotation speed increase calculated for each combustion includes the influence of the combustion variation among the cylinders and the like, the influence can be reduced by using the engine rotation speed increase integration value. As a result, calculation accuracy of the torque fluctuation can be improved.

The calculation processing of the torque fluctuation may be simplified by calculating the torque fluctuation based on the deviation between the engine rotation speed increase and the target engine rotation speed increase. Alternatively, the torque fluctuation may be calculated based on both of the deviation between the engine rotation speed increase and the target engine rotation speed increase and the deviation between the engine rotation speed increase integration value and the target engine rotation speed increase integration value to improve the calculation accuracy of the torque fluctuation.

In the second example embodiment, the torque fluctuation is calculated by using the engine rotation speed increase of each combustion. Alternatively, the torque fluctuation may be calculated by using the angular speed change or the angular acceleration of the crankshaft of each combustion as the information of the engine rotation speed increase of each combustion.

The present invention should not be limited to the disclosed embodiments, but may be implemented in many other ways without departing from the spirit of the invention.

What is claimed is:

1. A controller of an internal combustion engine, the controller comprising:

an interval setting device that sets a rotation speed calculation interval across a top dead center of a combustion stroke of the engine; and a rotation speed calculation device that calculates rotation speed of the engine based on angular speed of a crankshaft of the engine or information correlated with the angular speed in the rotation speed calculation interval.

2. The controller as in claim 1, wherein the interval setting device sets the rotation speed calculation interval shorter than a combustion interval of the engine.

3. The controller as in claim 2, wherein the interval setting device sets the rotation speed calculation interval at a crank angle range of 30° across the top dead center of the combustion stroke.

4. The controller as in claim 3, wherein the interval setting device sets the rotation speed calculation interval at a crank angle range from 10° before the top dead center of the combustion stroke to 20° after the top dead center.

5. The controller as in claim 2, wherein the interval setting device sets the rotation speed calculation interval at a crank angle range of 60° across the top dead center of the combustion stroke.

6. The controller as in claim 5, wherein the interval setting device sets the rotation speed calculation interval at a crank angle range from 10° before the top dead center of the combustion stroke to 50° after the top dead center.

7. The controller as in claim 2, wherein the interval setting device sets the rotation speed calculation interval at a crank angle range of 90° across the top dead center of the combustion stroke.

8. The controller as in claim 7, wherein the interval setting device sets the rotation speed calculation interval at a crank angle range from 10° before the top dead center of the combustion stroke to 80° after the top dead center.

9. The controller as in claim 1, further comprising:

a crank angle sensor that outputs a crank angle signal every time the crankshaft rotates through a predetermined crank angle, wherein the rotation speed calculation device calculates the angular speed of the crankshaft or the information correlated with the angular speed in the rotation speed calculation interval based on the crank angle signal.

10. A controller of an internal combustion engine, the controller comprising:

an interval setting device that sets a rotation speed calculation interval immediately after a top dead center of a combustion stroke of the engine; and a rotation speed calculation device that calculates rotation speed of the engine based on angular speed of a crankshaft of the engine or information correlated with the angular speed in the rotation speed calculation interval.

11. The controller as in claim 10, wherein the interval setting device sets the rotation speed calculation interval shorter than a combustion interval of the engine.

12. The controller as in claim 11, wherein the interval setting device sets the rotation speed calculation interval at a crank angle range from the top dead center of the combustion stroke to 30° after the top dead center.

13. The controller as in claim 11, wherein the interval setting device sets the rotation speed calculation interval at a crank angle range from the top dead center of the combustion stroke to 60° after the top dead center.

14. The controller as in claim 11, wherein the interval setting device sets the rotation speed calculation interval at a crank angle range from the top dead center of the combustion stroke to 90° after the top dead center.

15. The controller as in claim 10, further comprising:

a crank angle sensor that outputs a crank angle signal every time the crankshaft rotates through a predetermined crank angle, wherein the rotation speed calculation device calculates the angular speed of the crankshaft or the information correlated with the angular speed in the rotation speed calculation interval based on the crank angle signal.

16. A controller of an internal combustion engine, the controller comprising:

an interval setting device that sets a rotation speed calculation interval immediately after ignition timing of the engine; and a rotation speed calculation device that calculates rotation speed of the engine based on angular speed of a crankshaft of the engine or information correlated with the angular speed in the rotation speed calculation interval.

17. The controller as in claim 16, further comprising:

a crank angle sensor that outputs a crank angle signal every time the crankshaft rotates through a predetermined crank angle, wherein the rotation speed calculation device calculates the angular speed of the crankshaft or the information correlated with the angular speed in the rotation speed calculation interval based on the crank angle signal.

18. A controller of an internal combustion engine, the controller comprising:

an increase calculation device that calculates a rotation speed increase of the engine or rotation speed increase information correlated with the rotation speed increase for each combustion of the engine in a period in which the rotation speed increases immediately after a beginning of a start-up of the engine; and a fluctuation calculation device that calculates a torque fluctuation of the engine by comparing the rotation speed increase information calculated by the increase calculation device with target rotation speed increase information corresponding to a target air-fuel ratio.

19. The controller as in claim 18, further comprising:

an injection amount correction device that corrects a fuel injection amount based on the torque fluctuation calculated by the fluctuation calculation device.

20. A controller of an internal combustion engine, the controller comprising:

an increase calculation device that calculates a rotation speed increase of the engine or rotation speed increase information correlated with the rotation speed increase for each combustion of the engine in a period in which the rotation speed increases immediately after a beginning of a start-up of the engine;

an integration value calculation device that calculates a rotation speed increase information integration value by integrating the rotation speed increase information calculated by the increase calculation device; and a fluctuation calculation device that calculates a torque fluctuation of the engine by comparing the rotation speed increase information integration value calculated by the integration value calculation device with a target rotation speed increase information integration value corresponding to a target air-fuel ratio.

21. The controller as in claim 20, further comprising:

an injection amount correction device that corrects a fuel injection amount based on the torque fluctuation calculated by the fluctuation calculation device.

22. A controller of an internal combustion engine, the controller comprising:

an increase calculation device that calculates a rotation speed increase of the engine or rotation speed increase information correlated with the rotation speed increase for each combustion of the engine in a period in which the rotation speed increases immediately after a beginning of a start-up of the engine;

an integration value calculation device that calculates a rotation speed increase information integration value by integrating the rotation speed increase information calculated by the increase calculation device; and a fluctuation calculation device that calculates a torque fluctuation of the engine by comparing the rotation speed increase information calculated by the increase calculation device with target rotation speed increase information corresponding to a target air-fuel ratio and by comparing the rotation speed increase information integration value calculated by the integration value calculation device with a target rotation speed increase information integration value corresponding to the target air-fuel ratio.

23. The controller as in claim 22, further comprising:

an injection amount correction device that corrects a fuel injection amount based on the torque fluctuation calculated by the fluctuation calculation device.

* * * * *